US010718471B1

(12) United States Patent
Wu

(10) Patent No.: US 10,718,471 B1
(45) Date of Patent: Jul. 21, 2020

(54) LED LIGHT BULB

(71) Applicant: Jinjiang Wonderful Photoelectric Lighting Co., Ltd., Fujian (CN)

(72) Inventor: Linlin Wu, Fujian (CN)

( * ) Notice: Subject to any disclaimer, the term of this patent is extended or adjusted under 35 U.S.C. 154(b) by 0 days.

(21) Appl. No.: 16/526,993

(22) Filed: Jul. 30, 2019

(30) Foreign Application Priority Data

Apr. 22, 2019 (CN) ..... 2019 2 0546868 U

(51) Int. Cl.

| | |
|---|---|
| ***F21K 9/237*** | (2016.01) |
| ***F21K 9/235*** | (2016.01) |
| ***F21K 9/66*** | (2016.01) |
| ***F21V 23/00*** | (2015.01) |
| ***F21K 9/232*** | (2016.01) |
| ***F21K 9/238*** | (2016.01) |
| ***F21V 23/02*** | (2006.01) |
| *F21Y 115/10* | (2016.01) |

(52) U.S. Cl.
CPC ..... *F21K 9/237* (2016.08); *F21K 9/232* (2016.08); *F21K 9/235* (2016.08); *F21K 9/238* (2016.08); *F21K 9/66* (2016.08); *F21V 23/002* (2013.01); *F21V 23/02* (2013.01); *F21Y 2115/10* (2016.08)

(58) Field of Classification Search
CPC . F21K 9/237; F21K 9/66; F21K 9/238; F21K 9/232; F21K 9/235; F21V 23/002; F21V 23/02
See application file for complete search history.

(56) References Cited

U.S. PATENT DOCUMENTS

| | | | | |
|---|---|---|---|---|
| 10,386,020 | B2 * | 8/2019 | Choi | F21K 9/235 |
| 2016/0369949 | A1 * | 12/2016 | Wu | H05B 35/00 |
| 2017/0227169 | A1 * | 8/2017 | Jiang | F21V 9/30 |
| 2017/0276298 | A1 * | 9/2017 | Liu | F21V 19/005 |
| 2018/0045380 | A1 * | 2/2018 | Li | H01L 25/00 |
| 2018/0080612 | A1 * | 3/2018 | Haberkorn | F21V 19/0045 |
| 2018/0135810 | A1 * | 5/2018 | Lin | F21K 9/232 |
| 2018/0347766 | A1 * | 12/2018 | Choi | F21K 9/237 |
| 2019/0041007 | A1 * | 2/2019 | Cao | F21K 9/237 |
| 2019/0086037 | A1 * | 3/2019 | Cairns | F21K 9/232 |
| 2019/0203921 | A1 * | 7/2019 | He | F21V 29/508 |
| 2019/0264878 | A1 * | 8/2019 | Benshetrit | F21K 9/232 |
| 2019/0323695 | A1 * | 10/2019 | Wu | F21V 23/06 |
| 2019/0323697 | A1 * | 10/2019 | He | H01L 25/0753 |
| 2019/0331302 | A1 * | 10/2019 | Cai | F21V 29/70 |
| 2019/0338891 | A1 * | 11/2019 | Heil | F21K 9/232 |
| 2019/0368667 | A1 * | 12/2019 | On | F21K 9/232 |
| 2019/0386185 | A1 * | 12/2019 | Jiang | H01L 33/62 |

* cited by examiner

*Primary Examiner* — Anabel Ton
(74) *Attorney, Agent, or Firm* — Prakash Nama; Global IP Services, PLLC

(57) ABSTRACT

The present invention provides an LED light bulb comprising a transparent lampshade, a base, a transparent stem, a transparent seat, a power supply board fixedly mounted on the transparent seat, a first rigid conductive wire passing through the transparent stem, second rigid conductive wires passing through the transparent stem and connecting to the power supply board, and LED filaments fixedly connected to the first rigid conductive wire and the second rigid conductive wires. The second rigid conductive wires are two in number. The LED filaments are two or more in number. Each of the LED filaments are evenly distributed around the transparent stem, and each of the second rigid conductive wires is connected to at least one of the LED filaments.

4 Claims, 4 Drawing Sheets

LED LIGHT BULB

BACKGROUND OF THE INVENTION

The present invention relates to a light bulb and more particularly pertains to an LED light bulb.

Conventional light bulbs are usually tungsten light bulbs using tungsten wires as light-emitting components; they are relatively high in power consumption, relatively low in brightness and high in heat emission. Therefore, tungsten light bulbs are gradually replaced by LED light bulbs. However, the majority of LED light bulbs usually use a translucent but not transparent lampshade, which is quite different from conventional light bulbs in terms of outer appearance. Although some LED light bulbs use transparent lampshades, their LED filaments are usually mounted directly on the stems and it is necessary to embed rigid conductive wires on the stem beforehand (e.g. embed during sintering, thereby resulting in complicated manufacture and relatively high costs.

Besides, lampshades and stems of existing light bulbs are usually made of glass which is vulnerable. Glass lampshades and stems also need to be heated and sintered by an open fire during the manufacturing process. This induces certain safety risks.

In view of the above, the Applicant has conducted in-depth research on the structure of LED light bulbs, thereby devising the present invention.

BRIEF SUMMARY OF THE INVENTION

It is an object of the present invention to provide an LED light bulb that is simple to manufacture and relatively low in costs.

To attain this, the present invention adopts the following technical solution:

An LED light bulb comprises a transparent lampshade and a base fixedly connected to the transparent lampshade. It further comprises a transparent stem inside the transparent lampshade, a transparent seat fixedly connected to the transparent stem, a power supply board fixedly mounted on the transparent seat, a first rigid conductive wire passing through the transparent stem, second rigid conductive wires passing through the transparent stem and connecting to the power supply board, and LED filaments fixedly connected to the first rigid conductive wire and the second rigid conductive wires. The second rigid conductive wires are two in number. The LED filaments are two or more in number. Each of the LED filaments are evenly distributed around the transparent stem, and each of the second rigid conductive wires is connected to at least one of the LED filaments.

As an improvement of the present invention, the transparent lampshade, the transparent stem and the transparent seat are made of plastic.

As an improvement of the present invention, one end of the transparent seat which is distant from the base is provided with a positioning groove. The positioning groove has a groove bottom which is provided with an assembly hole for the transparent stem to pass through and two through holes. Each of the two through holes is for one of the second rigid conductive wires to pass through. Each of the second rigid conductive wires comprises a filament connection section and a power connection section which are mutually connected. The filament connection sections are inserted in the positioning groove. The power connection sections pass through the through holes. The transparent stem is integrally connected with pressing blocks. The pressing blocks press against the filament connection sections.

As an improvement of the present invention, one end of the transparent seat which is not provided with the positioning groove is provided with an inner bore. Each of the through holes connects with the inner bore. The power supply board is located inside the inner bore. The power supply board is provided with positioning holes. The inner bore is provided with positioning protrusions which match with the positioning holes and limiting plates which match with the power supply board.

As an improvement of the present invention, the transparent lampshade comprises an assembly portion inserted inside the base. A sealant is encapsulated between an outer sidewall of the assembly portion and an inner sidewall of the base.

As an improvement of the present invention, the base is a threaded base. An external threaded segment that matches with the threaded base is provided on the assembly portion.

With the above technical solution, the present invention has the following beneficial effects:

1. By providing the transparent stem and the transparent seat which are mutually connected, and connecting two ends of the LED filaments through their corresponding rigid conductive wires to the transparent stem and the transparent seat, the rigid conductive wires can be assembled without prior embedding, thereby resulting in simple manufacture and relatively low costs.

2. Since the transparent lampshade and the transparent stem are made of plastic, they are not vulnerable and can be formed by injection molding or blow molding during processing without using an open fire, and hence enhancing production safety.

3. By encapsulating the sealant, the waterproof performance of the light bulb is effectively improved.

4. By providing an external threaded segment on the assembly portion, the connection stability between the lampshade and the base can be improved.

10-transparent lampshade; 11-assembly portion; 11*a*-outer sidewall of the assembly portion; 11*b*-external threaded segment; 20-base; 20*a*-inner sidewall of the base; 30-transparent stem; 31-pressing block; 40-power supply board; 41-positioning hole; 50-first rigid conductive wire; 60-LED filament; 70-transparent seat; 71-positioning groove; 72-assembly hole; 73-through hole; 74-inner bore; 75-positioning protrusion; 76-limiting plate; 80-second rigid conductive wire; 81-filament connection section; 82-power connection section; 90-sealant.

DETAILED DESCRIPTION OF THE INVENTION

The present invention will be further described below in conjunction with the accompanying drawings and specific embodiment.

Figure 1:
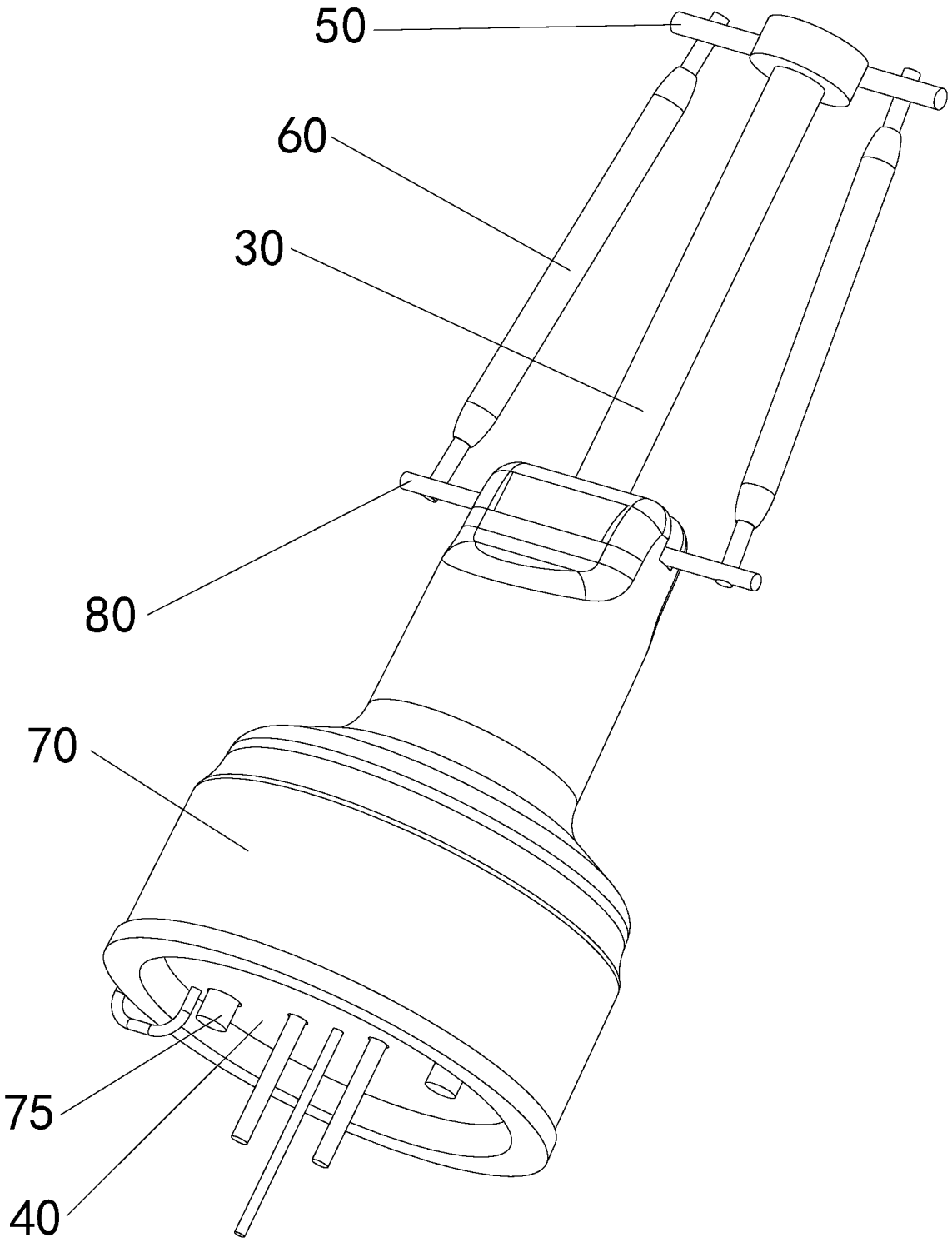
FIG. 1 shows a schematic view of the structure of an LED light bulb of the present invention, in which the transparent lampshade and the base are omitted.
Figure 2:
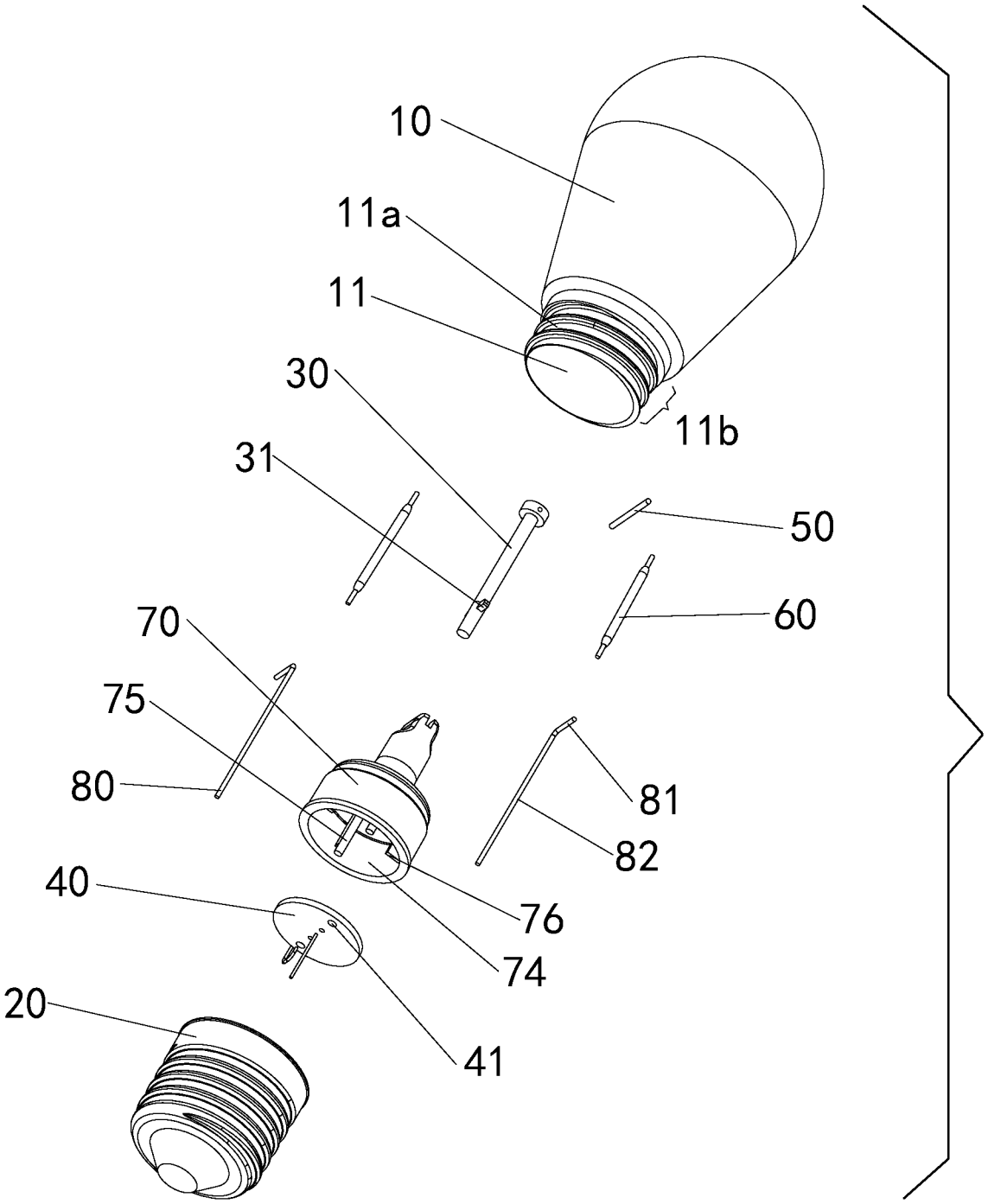
FIG. 2 shows a exploded view of the LED light bulb of the present invention.
Figure 3:
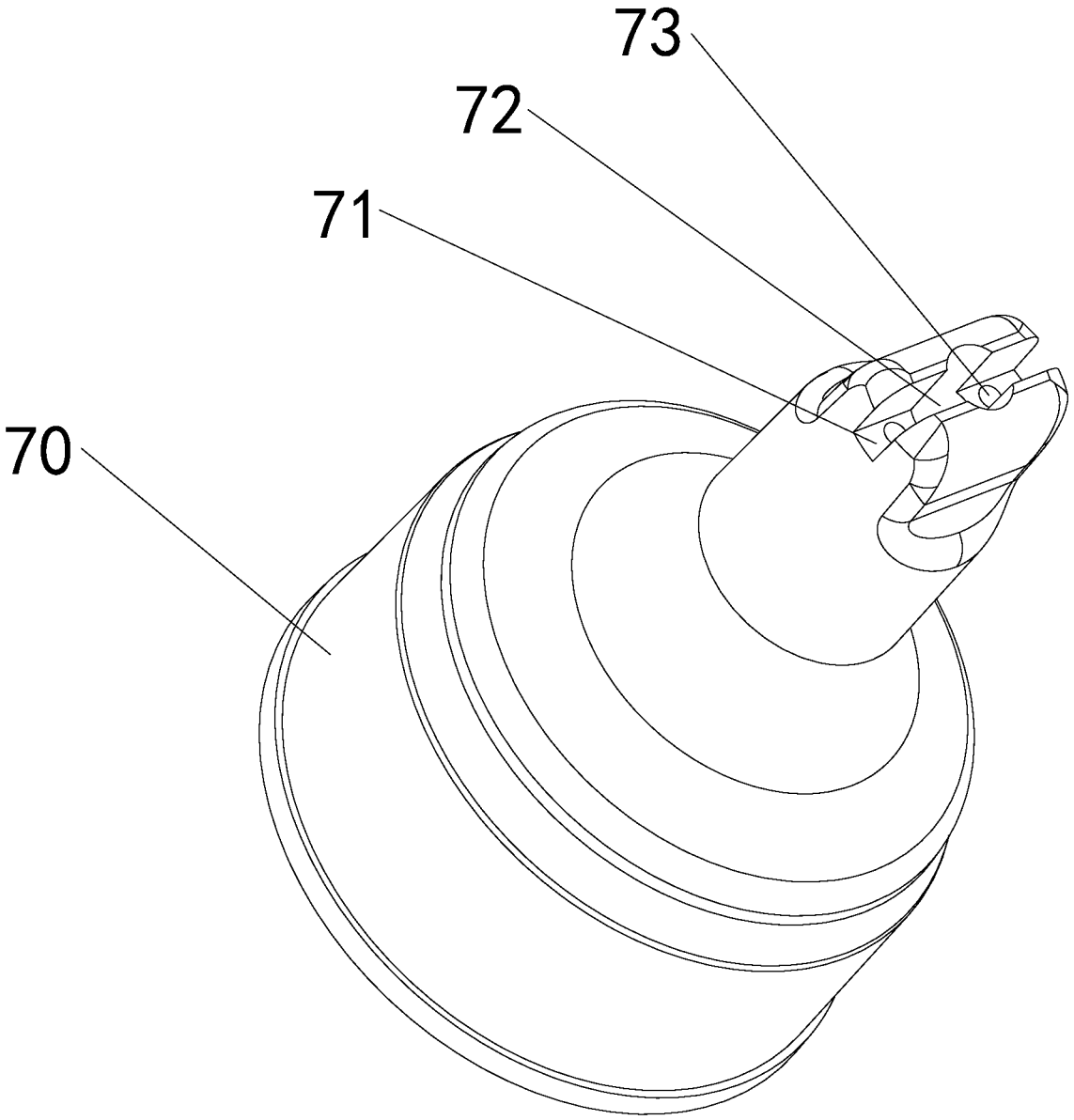
FIG. 3 shows a schematic view of the structure of the transparent seat of the present invention.
Figure 4:
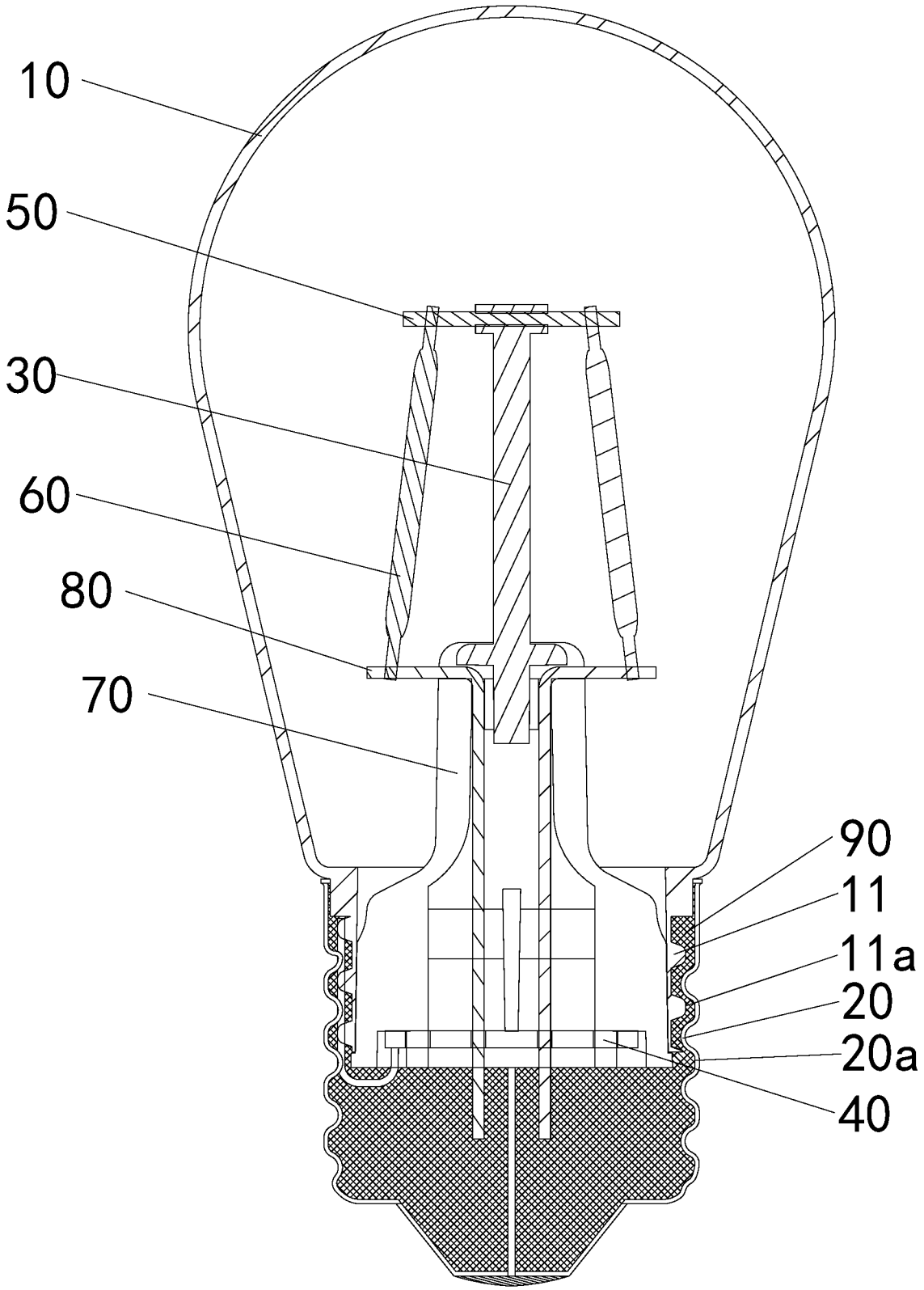
FIG. 4 is a cross-sectional view of the LED light bulb of the present invention.

As illustrated in FIGS. 1, 2, 3 and 4, the LED light bulb of the present invention comprises a transparent lampshade 10, a base 20 fixedly connected to the transparent lampshade 10, a transparent stem 30 inside the transparent lampshade 10, a transparent seat 70 fixedly connected to the transparent stem 30, a power supply board 40 fixedly mounted on the transparent seat 70, a first rigid conductive wire 50 passing through the transparent stem 30, second rigid conductive wires 80 passing through the transparent seat 70 and connecting to the power supply board 40, and LED filaments 60 fixedly connected to the first rigid conductive wire 50 and the second rigid conductive wires 80. The transparent lampshade 10, the transparent stem 30 and the transparent seat 70 are made of plastic, thereby improving the anti-drop capability of the light bulb and avoiding the use of open fire in the manufacturing process (plastic parts can be blow-molded or injection-molded).

The transparent lampshade 10 comprises an assembly portion 11 inserted inside the base 20. The portion of the transparent lampshade 10 which is not inserted inside the base 20 has an outer appearance which is identical to the lampshade of a conventional tungsten light bulb, and the specific shape can be designed according to actual needs. The base 20 is a threaded base used in conventional tungsten filament light bulbs. Its main body is usually pressure formed by a metal sleeve. Therefore, when an external thread of the threaded opening of the base 20 is formed, an internal threaded bore is naturally formed in the interior of the base 20. An external threaded segment 11*b* that matches with the internal threaded bore of the threaded base is provided on the assembly portion 11. A sealant 90 is encapsulated between an outer sidewall 11*a* of the assembly portion 11 and an inner sidewall 20*a* of the base 20. In this way, the connection is more secured so that the transparent lampshade 10 and the base 20 are not easily disconnected due to external force when the light bulb is installed, and the waterproof performance of the light bulb is effectively improved.

One end of the transparent seat 70 which is distant from the base 20 is provided with a positioning groove 71. The positioning groove 71 is linearly arranged and parallel to the radial direction of the base 20. The positioning groove 71 has a groove bottom which is provided with an assembly hole 72 for the transparent stem 30 to pass through and two through holes 73 for the second rigid conductive wires 80 to pass through respectively. The assembly hole 72 is located between the two through holes 73. One end of the transparent seat 70 which is not provided with the positioning groove 71 is provided with an inner bore 74. Each of the through holes 73 connects with the inner bore 74. It can be determined according to actual needs whether the assembly hole 72 connects with the inner bore 74. In addition, the outer diameter of the end of the transparent seat 70 where the positioning groove 71 is not provided matches the diameter of the mouth of the lampshade 10; preferably, the two are clearance fitted to each other to achieve a fixed connection between the two via the sealant.

The first rigid conductive wire 50 is arranged in parallel with positioning groove 71 and fixedly passes through one end of the transparent stem 30 which is distant from the transparent seat 70. The first rigid conductive wire 50 can be connected to the transparent stem 30 by insert molding, or by opening a hole in the transparent stem 30 for the first rigid conductive wire 50 to pass through and form an interference fit therewith, thereby achieving connection.

The second rigid conductive wires 80 each comprises a filament connection section 81 and a power connection section 82 which are mutually connected and perpendicular to each other. The filament connection sections 81 are inserted in the positioning groove 71. The power connection sections 82 pass through the through holes 73. Of course, there are two second rigid conductive wires 80. The power connection sections 82 of the two second rigid conductive wires 80 pass through the corresponding through holes 72 and connect to the positive output interface and the negative output interface on the power supply board 40 respectively, and the ends of the filament connection sections 81 of the two second rigid conductive wires 80 which are distant from the corresponding power connection sections 82 are arranged back to back.

The transparent stem 30 is integrally connected with pressing blocks 31. The pressing blocks 31 are also transparent. The pressing blocks 31 press against the filament connection sections 82 and are partially embedded in the positioning groove 71. Since there are two filament connection sections 82, there are also two pressing blocks 31.

The power supply board 40 may be a power supply board used in a conventional LED light bulb. It is located inside the inner bore 74. Preferably, the power supply board 40 provided in this embodiment is provided with positioning holes 41 on the basis of a conventional power supply board, and the inner bore 74 is provided with positioning protrusions 75 which match with the positioning holes 41 and limiting plates 76 which match with the power supply board 40 to enable connection between the transparent seat 70 and the power supply board 40. Of course, if necessary, the positioning protrusions 75 can also be provided with snap structure.

The LED filaments 60 are linearly arranged, and there are two or more. In this embodiment, two LED filaments 60 are used as an example. The LED filaments 60 are evenly distributed around the transparent stem 30, and each of the second rigid conductive wires 80 is connected to at least one of the LED filaments 60, thereby forming a return circuit. In the present embodiment, the two LED filaments 60 are respectively and fixedly connected to the two second rigid conductive wires 80 as one-to-one connection. Specifically, one end of each of the LED filaments 60 is connected to the corresponding second rigid conductive wire 80, and the other end thereof is connected to the first rigid conductive wire 50.

The present embodiment further provides a manufacturing method of the aforementioned LED light bulb. The manufacturing method comprises the following steps:

S1: Injection blowing of the lampshade: PC transparent plastic material is heated by an industrial injection blowing machine to a temperature of about 270° C. and then injected into a lampshade mold for high-speed pressurized injection blowing to obtain the transparent lampshade 10.

S2: SMT processing: Apply solder paste or red adhesive on the electronic component mounting position of the power supply board solder pad (including the PCB board), and then adhere the electronic components to their corresponding positions on the power supply board by an automatic mounting machine. The electronic components are then soldered to the power supply board solder pad by reflow soldering to form a semi-finished power supply board. The electronic components and the power supply board solder pad are conventional components whose structures are the same as those of conventional LED light bulbs and are therefore not detailed herein.

S3: Plug-in components processing: Feed the semi-finished power supply board adhered with the electronic components to a plug-in components assembly line; insert two lead wires according to the positions marked by L and N on the PCB board of the semi-finished power supply board, and then put it into a wave soldering furnace for wetting to obtain a power supply board 40.

S4: Semi-finished product inspection: First, visually check whether the surface of the PCB board is clean, whether there is any absent electronic component, and whether wetting of the power supply board solder pad is proper; then put the semi-finished power supply board into a testing fixture for testing.

S5: Assembling the rigid conductive wires: Use a fixture to mount the first rigid conductive wire 50 on the transparent stem 30, and mount the second rigid conductive wires 80 on the transparent seat 70.

S6: Assembling the transparent stem: Insert the transparent stem 30 through the assembly hole 72 while ensuring that the pressing blocks 31 are pressed against the filament connection sections 82 and partially embedded in the positioning groove 71 to form an assembled component.

S7: LED filaments soldering: Place the assembled component and the LED filaments 60 in the fixture; use a high frequency DC spot soldering machine to securely solder the rigid conductive wires and the LED filaments 60.

S8: Soldering the power supply board: Insert the two second rigid conductive wires 80 through the corresponding output interfaces of the power supply board 40 according to their polarity, then place them in the fixture, and use a soldering iron to solder to the power supply board solder pad firmly.

S9: Power-on test: With a power supply of AC120V 60HZ, perform lighting test using a test probe.

S10: Assembling the lampshade: Align the transparent stem 30 with the transparent lampshade 10 and assemble the two; remove the rubber cover of the wire on the N-electrode of the power supply board 40, and bend the exposed copper wire from one side of the transparent lampshade 10 to abut against the threaded surface of the transparent lampshade 10; the transparent lampshade 10 is then placed in the fixture with its tip pointed downward.

S11: Copper soldering of solder joint of the threaded opening: Put the base 20 with its threaded opening facing downward on the wire of the L-electrode of the power supply board 40; use an electric iron to wet the solder joint with tin; the solder joint is required to have an arc shape, a smooth surface and without burrs.

S12: Encapsulating glue: Bend the connecting wire of the threaded opening of the base 20 which is soldered with the solder joint, and position it to an automatic glue dispenser with the threaded opening facing upward. When the outlet of the automatic glue dispenser is aligned with the threaded opening, press the machine switch to apply a standard amount of glue (i.e. sealant 90) to the threaded opening. The standard amount is the same as that of a conventional LED light bulb and therefore will not be detailed herein.

S13: Fastening the threaded opening: Fasten the threaded opening of the base 20 with glue applied thereon to the lampshade according to the screw thread direction and place them to the fixture, and wait for the glue to solidify to obtain an LED light bulb.

S14: Testing the finished product: Visually inspect the appearance of the LED light bulb with solidified glue; check for leakage, whether the threaded opening is in place, and whether there is any residue inside the lampshade; then perform testing with a power supply of AC120V 60HZ.

The present invention is described in detail above in conjunction with the accompanying drawings, but the present invention is capable of other embodiments and is not limited by the above embodiment. Any variations based on the prior art performed by a person skilled in the art falls within the scope of protection of the present invention.

What is claimed is:

1. An LED light bulb comprising a transparent lampshade and a base fixedly connected to the transparent lampshade, characterized in that it further comprises a transparent stem inside the transparent lampshade, a transparent seat fixedly connected to the transparent stem, a power supply board fixedly mounted on the transparent seat, a first rigid conductive wire passing through the transparent stem, second rigid conductive wires passing through the transparent stem and connecting to the power supply board, and LED filaments fixedly connected to the first rigid conductive wire and the second rigid conductive wires; the second rigid conductive wires are two in number; the LED filaments are two or more in number; each of the LED filaments are evenly distributed around the transparent stem, and each of the second rigid conductive wires is connected to at least one of the LED filaments; the transparent lampshade, the transparent stem and the transparent seat are made of plastic; one end of the transparent seat which is distant from the base is provided with a positioning groove; the positioning groove has a groove bottom which is provided with an assembly hole for the transparent stem to pass through and two through holes; each of the two through holes is for one of the second rigid conductive wires to pass through; each of the second rigid conductive wires comprises a filament connection section and a power connection section which are mutually connected; the filament connection sections are inserted in the positioning groove; the power connection sections pass through the through holes; the transparent stem is integrally connected with pressing blocks; the pressing blocks press against the filament connection sections.

2. The LED light bulb as in claim 1, wherein one end of the transparent seat which is not provided with the positioning groove is provided with an inner bore; each of the through holes connects with the inner bore; the power supply board is located inside the inner bore; the power supply board is provided with positioning holes; the inner bore is provided with positioning protrusions which match with the positioning holes and limiting plates which match with the power supply board.

3. The LED light bulb as in claim 1, wherein the transparent lampshade comprises an assembly portion inserted inside the base; a sealant is encapsulated between an outer sidewall of the assembly portion and an inner sidewall of the base.

4. The LED light bulb as in claim 3, wherein the base is a threaded base; an external threaded segment that matches with the threaded base is provided on the assembly portion.

* * * * *